United States Patent [19]

Teixeira et al.

[11] 4,326,564

[45] Apr. 27, 1982

[54] LOOM STOP MOTION SYSTEM AND METHOD

[75] Inventors: Manuel G. Teixeira, Cumberland; Rene J. Valois, Woonsocket, both of R.I.

[73] Assignee: Lessona Corporation, Warwick, R.I.

[21] Appl. No.: 117,380

[22] Filed: Jan. 31, 1980

[51] Int. Cl.[3] ..... D03D 51/34

[52] U.S. Cl. ..... 139/370.2; 66/163

[58] Field of Search ..... 139/336, 370.1, 370.2; 66/163; 250/571; 340/675, 676, 677

[56] References Cited

U.S. PATENT DOCUMENTS

| | | | |
|---|---|---|---|
| 3,563,281 | 2/1971 | Pfarrwaller | 139/370.2 |
| 3,608,590 | 9/1971 | Hohener | 139/370.2 |
| 3,807,199 | 4/1974 | Rosen | 66/163 |
| 4,095,621 | 6/1978 | Kakinaka | 139/370.2 |
| 4,215,728 | 8/1980 | Weidmann et al. | 139/370.2 |
| 4,228,828 | 10/1980 | Loepfe et al. | 139/370.2 |

*Primary Examiner*—Henry Jaudon

*Attorney, Agent, or Firm*—Burnett W. Norton

[57] ABSTRACT

A precise, accurate and sensitive control method and system for actuating the stop motion mechanism of a weaving loom equipped with a weft yarn storage feeder unit is disclosed. The storage and feeder unit includes a device for applying tension to the weft yarn being delivered from a weft yarn supply to the storage and feeder device. The tension device is equipped with a switch which provides a first electrical signal when the weft yarn being supplied to the storage and feeder device becomes slack or interrupted. That switch is connected with the weft yarn storage and feeder unit motor circuit. The weft yarn storage and feeder unit may be intermittently driven as the need occurs for feeding a weft yarn length or pick into the loom. The loom is stopped only in the presence of two concurrent signals, namely (1) a signal generated upon the detection of slack weft yarn or the absence of yarn in the tension device and (2) a simultaneous signal indicating operation of the motor to drive the weft yarn storage and feeder device. By the operation of the loom stop motion mechanism only in the presence of the aforementioned simultaneous signals, short picks, i.e., insertion of weft yarn lengths less than that required to extend from one side of the fabric being woven to the other, is precluded. Further, false signals which might arise from simple slackening of the yarn in the zone of the tension device are not operative to halt the loom.

4 Claims, 2 Drawing Figures

LOOM STOP MOTION SYSTEM AND METHOD

BACKGROUND OF THE INVENTION

In the art of weaving it is well known to provide a weft or filling yarn storage and feeder device or simply "feeder" which operates to store weft yarn for use by the loom, normally a shuttleless loom. The device includes a yarn collecting drum on which weft yarn from a supply source is wound temporarily and then removed under controlled, uniform tension. Such devices eliminate the wide variations in yarn tension which occur when a yarn is delivered from a supply source such as a cone or package, and permits the yarn to be fed to the loom at a substantially constant tension. This art is exemplified by U.S. Pat. No. 3,776,480 to John B. Lawson granted Dec. 4, 1973 and U.S. Pat. No. 3,853,153 granted Dec. 10, 1974 to A. H. Van Duyhoven et al. Typically, such feeders may have either a rotary drum upon which the yarn is wound as the drum is driven by a suitable motive source such as an electric motor or, the feeders may incorporate a stationary drum with an orbiting flyer driven by, say, an electric motor and engaging the weft yarn to apply it to the surface of the stationary drum. For purposes of the present disclosure, reference will be made to the so-called stationary drum feeder although it should be understood that the present invention has equal application to rotary drum feeders.

It is also known in the art to equip feeders of the type just discussed with tension devices arranged upstream of the feeder to impart some predetermined level of tension into the weft yarn being advanced from a weft yarn storage supply to the feeder. These tension devices may include means for automatically stopping the loom in the event of weft yarn breakage or undue slackening of the yarn in the area of the tension unit. Exemplifications of such arrangements are found in U.S. Pat. No. 1,516,885 granted Nov. 25, 1924 to L. T. Houghton and U.S. Pat. No. 2,202,323 granted May 28, 1940 to W. T. Sullivan. These devices as well as other automatic loom stopping devices are positioned in the weft yarn feed path and operate conventionally to actuate pneumatic, electric eye or mechanical switch control circuits which are adapted to stop the weaving loom.

In conventional weaving operations heddles are raised which, in turn, raise warp yarns to create an opening or shed. The filling or weft yarn is then inserted through the shed from one side of the loom to the other. A single crossing of the weft yarn through the shed is called a "pick". Weft storage feeders of the type contemplated herein will normally store enough weft yarn on the drums to equal several pick lengths. Of course, in the event the weft yarn being conveyed from the supply source to the feeder is interrupted, the weft yarn stored on the feeder drum will ultimately become exhausted if the loom continues to operate. In that event, the yarn or "pick" when inserted into the shed will produce a defect. This results from the fact that in almost every case the final length of broken yarn on the feeder drum is less than the length required for the pick to extend from one side of the loom to the other. In consequence of the insertion of a short pick into the fabric the loom attendant must insure that the loom is stopped and then proceed with the laborious task of removing the short pick. This, of course, results in much down time in the weaving operation. Additionally, and equally significant, when the loom is restarted the area of the fabric where the broken pick has been removed and a new pick of proper length has been inserted will often show a defect due to the fact that the new pick will not precisely position itself in the location where the short pick was removed. Thus, it is evident that it is highly desirable to insure that short picks are not inserted into the fabric during the weaving operation and, moreover, that the loom is not stopped simply as a result of false signals produced as a result of mere slackening of the weft supply yarn in the zone of the feeder tension unit.

In operation with looms which employ a variety of different weft yarns it is normal to utilize a separate feeder for accomodating each of the several different weft or filling yarns. It will be quite obvious that while a pick of one specific weft yarn is being inserted into the fabric the other weft supply yarns are inactive. That is to say, the further weft yarns are withheld from entry to the shed. Commonly, a selected one of the multiplicity of different weft yarns may have a plurality of picks sequentially inserted into the shed before a different weft yarn is selected for filling insertion. During these intervals when the weft yarns are inactive it follows that their companion feeders and the related tension units are inactive. Due to the various vibrations and other conditions surrounding the normal weaving operation it readily occurs that the weft supply yarns which are stationary become slack between their sources of supply and the tension devices. Recognizing that the tension devices utilized with feeders are commonly of the "gate" type of, say, the type sold as Model UTC 2003-1by the Steel Heddle Manufacturing Company, Greenville, South Carolina, the tension devices respond to the slackening tension by assuming a closed position. This motion can operate a switch arranged with the tension unit to deliver a signal to the automatic loom stopping device thereby arresting operation of the loom. This, of course, is a highly undesirable condition since the signal is false in that the weft yarn supply is intact and has simply fallen slack due to the aforementioned vibrations.

On the other hand, if, in fact, the closing of the gate type tension arises from the fact that the weft supply yarn has been interrupted as by a breaking, it becomes most desirable that the loom be halted immediately. Otherwise, the feeder will have collected the yarn up to the point where the break has occurred and will supply that yarn as a filling into the fabric, generally resulting in the previously discussed short pick occurring. Significantly, the present invention operates only when two signals simultaneously occur. That is, a signal from the feeder tension device indicating that the weft yarn from the supply source has been interrupted and a signal indicating that the feeder motor is operating. By this ingenious arrangement the present invention avoids the possibility of false signals occurring due to simple slackening of the weft supply yarn in the zone of the feeder tension unit and, at the same time, avoids insertion of short picks in the fabric by shutting down the loom when the feeder motor is operating and slackened weft supply yarn is sensed in the zone of the feeder tension device. Slack yarn will not occur when the feeder is operating because the feeder, drawing yarn from the weft supply, imparts enough tension on the yarn in the region of the tension device to hold the weft yarn taut so long as the weft yarn being delivered off the supply is not broken. Thus, it is logical that if the gates of the tension device close while the feeder motor is running, the supply weft yarn is broken.

Therefore, it is one object of the present invention to provide means and method for preventing false signals inducing stoppage of the weaving loom.

Another object of the present invention is to provide means and method for avoiding the insertion of short picks into fabric being woven on a loom equipped with a weft yarn storage and feeder device.

Still another object of the present invention is to provide means and method for arresting operation of a weaving loom in response to simultaneous signals derived from a tension device associated with the weft yarn feeding device indicating an interruption in the weft supply to the feeder coupled with a companion signal indicating that the motor of the feeder is operational to provide a demand for weft yarn from the weft supply source which would normally establish the requisite tension in the weft yarn to preclude its being slack in the area of the tension device.

Other objects of the invention will impart the obvious and will in part be described hereinafter.

DESCRIPTION OF THE DRAWINGS

Further features, objectives and advantages of the invention will be evident from the following description which makes reference to the accompanying drawing wherein.

DESCRIPTION OF A PREFERRED EMBODIMENT

Figure 1:
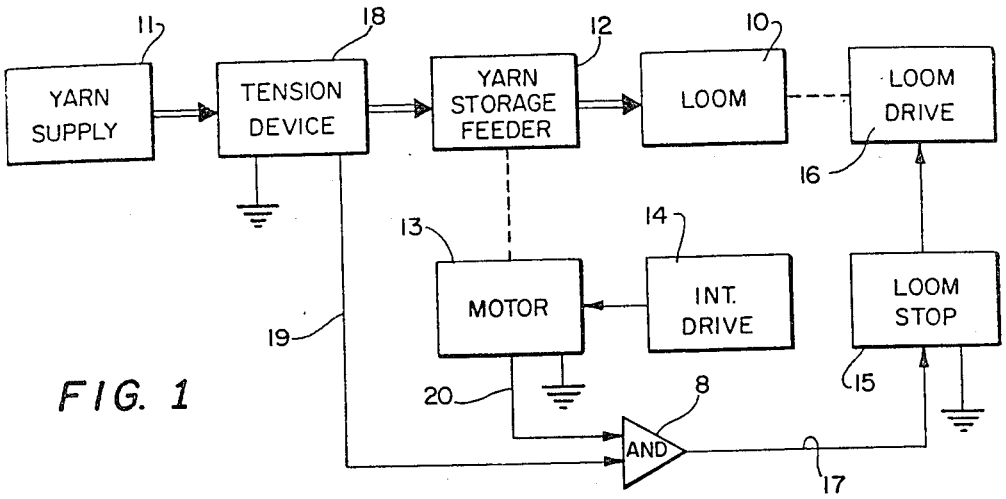
FIG. 1 is a system block diagram setting forth the control system and method afforded by this invention.

As seen in the block diagram of FIG. 1, there is a yarn supply system feeding yarn (designated by double line notation) in a supply path to a loom 10 from a supply package or the like 11 through a feeder 12 having a yarn delivery flyer which is driven by a motor 13 as indicated by the dotted line mechanical connection. This is a conventional stationary drum feeder system as illustrated in the aforementioned U.S. Pat. No. 3,776,480 and includes intermittent drive means 14 which senses the need to collect additional weft yarn on the feeder and, thus, to energize and run the motor 13. The single line notation represents electrical control circuitry.

The loom stop control means 15 coupled to the loom drive 16 is also conventional, acting in response to a control signal at lead 17, which in the past has been supplied by either a yarn presence sensing device or a tension device such as 18 of the nature shown for example in the aforementioned U.S. Pat. No. 2,202,323.

It is to be understood that variations of the loom stop control circuits, the feeder, the intermittent drive means and the yarn tension devices are well known in the art and that the block designation represents a range of equivalent devices. However, it is found that a tension device Model UTC 2003-1 of Steel Heddle Manufacturing Company, as previously referenced herein, is particularly adapted for the control circuits of this invention.

In operation this invention, in contrast to the prior art which uses a single tension control signal at 17 to stop the loom, provides AND circuit 8 that requires coincidence of two conditions to stop the loom.

Thus, when the tension device 18 signals a slack in the yarn by a control signal such as closing a switch that is sensed on lead 19, and simultaneously a control signal appears on lead 20 signifying that the feeder motor is being driven, then the loom is stopped by control circuits 15, 16. The ground symbols symbolize a completion of circuits between the several electrical control circuits, but some control circuits such as the preferred embodiment of FIG. 2 may not have ground connections.

It is clear then, in operation feeder 12 puts a tension on the yarn passing through tension device 18 when the feeder is operated and if the slack signal appears at that time it is because of broken yarn or some other condition which will improperly feed the weft supply yarn and thus adversely affect the weft lengths being fed to feeder 12 and into loom 10, thereby causing defects in the fabric being woven on the loom. Hence, the loom need be stopped under these conditions.

If only the tension device 18 were relied upon to stop the loom there may be a tendency, because of the intermittent operation of the feeder 12, for some slack to appear in the yarn feed path. Reasons for development of such slack have previously been discussed. If the tension device 18 were constructed to ignore such changes of slack the tension device would, of necessity, be very insensitive and could not quickly stop the loom when necessary to avoid defects in the output product.

Tension device 18 may be positioned in a particular installation at a convenient place in the yarn feed path to the loom 10 where an expected tension is to be sensed. In practice with the present invention tension device 18 is supported on a suitable bracket (not shown) on feeder 12 at the upstream end thereof and in the weft yarn path to the feeder. However, a yarn presence signal may be generated between the feeder 12 and the loom 10 or at other positions in the feed system if desired for producing that necessary concurrent signal on lead 19 of FIG. 1.

Figure 2:
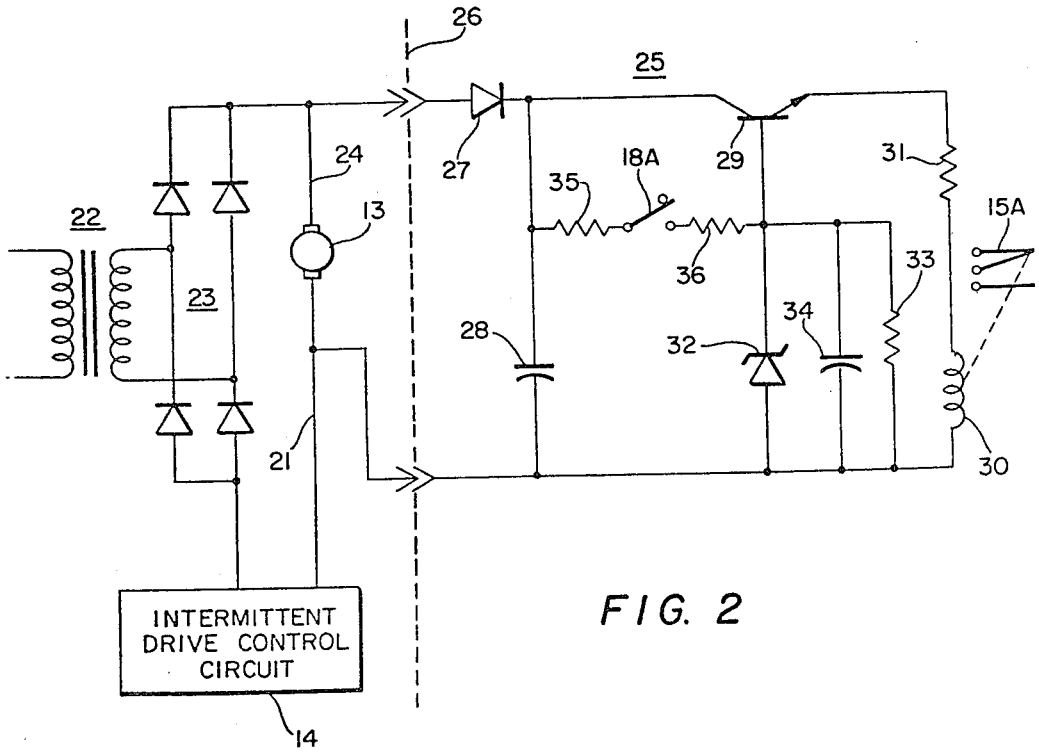
FIG. 2 is a schematic circuit diagram of a loom stop control circuit responsible to two sensed loom control conditions in accordance with the present invention.

Now with reference to the preferred electronic control circuit embodiment of FIG. 2, the intermittent drive control circuit 14 controls in a conventional manner the current in the first motor lead 21 to the d-c motor 13 which drives the yarn applying flyer of the yarn feeder 12. The transformer 22 and rectifier circuit 23 completes the d-c path to the other motor lead 24. The loom stop control circuit 25 afforded by this invention therefore is plugged into a parallel circuit with d-c motor 13 as represented by plug 26.

Isolating rectifier 27 provides a high back impedance with condenser 28 to retain d-c charge in response to intermittent drive periods of the motor 13 useful as a control signal to the base at transistor 29. Thus, if the slack control switch 18A, operable by the slack occurring in the zone of tension device 18 is closed, the low forward impedance of diode 27 and transistor 29 will permit motor supply current to operate the relay coil 30, whose contacts 15A serve to stop the loom. Zener diode 32 and resistor 31 limit the voltage across relay coil 30 to 3 volts. Resistors 35 and 36 and capacitor 34, delay the voltage increasing across relay 30, therefore delaying the relay 30 contact closure for approximately 0.5 seconds after switch 18A closes. This is desirable to prevent a false stop signal in the event of a momentary slack in the yarn; and also, when the feeder starts and switch 18A is closed due to slack in the yarn.

Note that the entire power to this control circuit is the current in the motor feed path between leads 21 and 24 and that the relay 30 is operable from this current, as responsive to the gating of AND circuit transistor 29 into its low impedance emitter collector path when switch 18A is closed in the slack sensing direction.

Zener diode 32, resistor 33 and capacitor 34 retain a constant bias on the base of transistor 29 holding it in its low impedance state when switch 18A is closed as current flows from capacitor 28 under limit of resistors 35, 36.

Thus, it is seen that only when drive current is supplied to motor 13 from the intermittent drive control circuit 14 can the relay 30 stop the loom, but that the relay cannot operate unless the concurrent condition of slack in the yarn is detected by switch 18A.

It is evident that this invention has improved the state of the art and solved problems existing in prior art loom control methods by providing a new mode of loom stop control and corresponding loom control systems. In looms which are fed weft yarn lengths from a supply through intermediate weft yarn storage and feeder units, loom stoppage resulting from weft supply yarn feed problems is quickly and accurately controlled in response to the presence of slack in the yarn feed system, without unnecessary loom down time and defective output product occurring from false signals. Accordingly, those novel featues believed representative of the spirit and nature of this invention are defined with particularity in the claims which follow.

What is claimed is:

1. A loom control system operable to stop the loom in the presence of slack or breakage of a supply yarn comprising in combination; a yarn supply system feeding yarn in a supply path to a loom through intermediate yarn feeder means driven intermittently by a motor in response to the need to feed the yarn intermittently to the loom, a control circuit for stopping the loom, means sensing a slack or broken condition of said yarn in the supply path, means sensing the intermittent drive to said motor including an electronic circuit coupled across the motor, a control relay driven by an amplifier device, and means actuating said amplifier device to operate said control relay in the concurrent presence of slack or breakage of the yarn in the supply path and drive to said motor to stop the loom.

2. A loom control system as set forth in claim 1 wherein said means sensing the slack or breakage comprises yarn tension sensing means located in said path between said yarn supply and said yarn feeder means.

3. A loom control system responsive to stop the loom in the presence of slack or breakage of a supply yarn comprising in combination; a yarn supply system feeding yarn in a supply path to a loom through intermediate yarn feeder means driven intermittently by a motor in response to the need to feed the yarn intermittently to the loom, a control circuit for stopping the loom, means sensing a slack or broken condition of said yarn in the supply path, means sensing the intermittent drive to said motor and, actuating means responsive to the concurrent presence of slack or breakage in said yarn in said supply path and drive to the motor for actuating said control circuit to stop the loom, said actuating means including a relay operable from a current source supplied to said motor, and means gating the current to the relay in response to said sensing of slack or breakage in the yarn.

4. A loom control system as set forth in claim 3 wherein said means sensing the slack or breakage comprise yarn tension sensing means located in said path between said yarn supply and said yarn feeder means.

* * * * *